United States Patent [19]

Pedersen

[11] Patent Number: 4,611,802

[45] Date of Patent: Sep. 16, 1986

[54] PAPER FEEDER

[75] Inventor: Egon A. Pedersen, Diablo, Calif.

[73] Assignee: Qume Corporation, San Jose, Calif.

[21] Appl. No.: 599,397

[22] Filed: Apr. 12, 1984

[51] Int. Cl.[4] ..... B65H 5/06

[52] U.S. Cl. ..... 271/274; 400/637.5; 400/637.6

[58] Field of Search ..... 271/274, 272, 273, 268, 271/277; 400/637, 637.1, 637.2, 637.5, 637.6

[56] References Cited

U.S. PATENT DOCUMENTS 3,966,037 6/1976 Zambolin ..... 400/637 X
4,486,108 12/1984 Tanaka ..... 400/637.1 X

OTHER PUBLICATIONS

Gerhardt, A. J., "Spring Design to Positively Retain Axle for Pressure Roll System", IBM Technical Disclosure Bulletin, vol. 19, No. 2, Jul. 1976, p. 676.

Lloyd, E. R. et al., "Paper Feed Mechanism", vol. 23, No. 2, Jul. 1980, p. 678.

Estabrooks, D. C. et al., "Nip Roller/Force Equalizing Assembly", IBM Technical Disclosure Bulletin, vol. 23, No. 3, Aug. 1980, p. 939.

*Primary Examiner*—Bruce H. Stoner, Jr.
*Assistant Examiner*—Lawrence J. Goffney, Jr.
*Attorney, Agent, or Firm*—T. L. Peterson; J. M. May

[57] ABSTRACT

A paper feeder is described, of the type which includes a cylindrical platen (16) and multiple pressure rollers (18,20) that press paper between themselves and the platen, which is of simple and inexpensive construction. The paper feeder includes a shaft (34) of square cross-section, a group of leaf springs (30) with inner ends mounted on the shaft and outer ends lying under the platen, and a group of roller assemblies (38) mounted on the outer ends of the leaf springs. The inner end of each leaf spring has tabs (40,42) on opposite sides, which are bent down at substantially right angles and which have square slots (46) for closely receiving the square shaft. The group of perhaps five leaf springs are mounted on the shaft with their tabs abutting one another, and with grip rings on opposite ends of the shaft to hold the springs in place.

1 Claim, 5 Drawing Figures

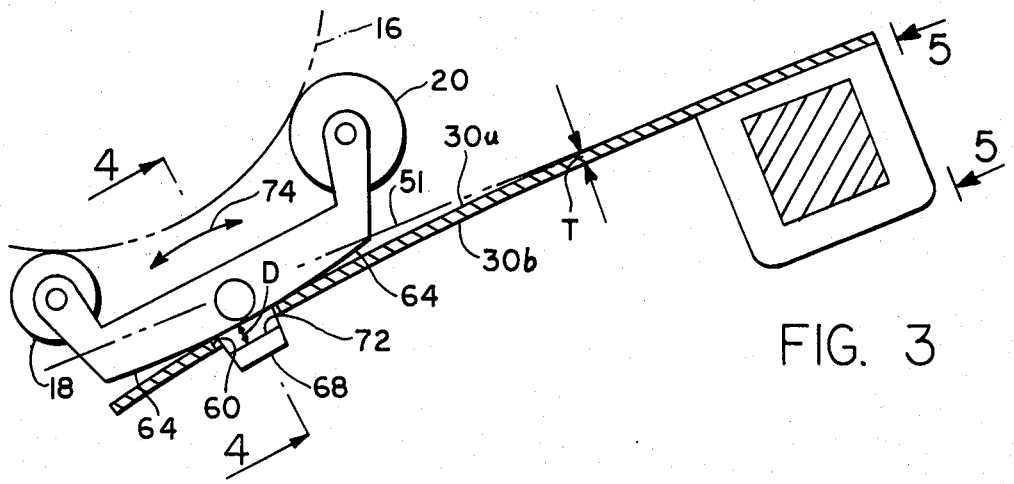
FIG. 3
FIG. 4
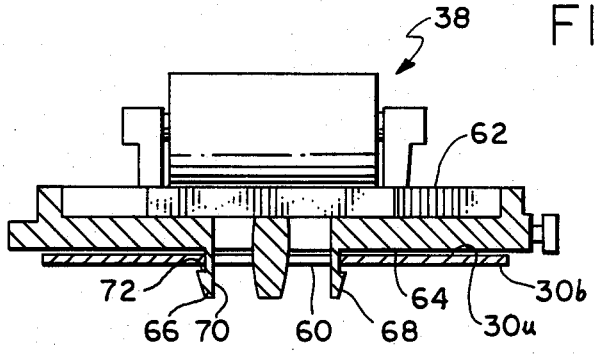
FIG. 5
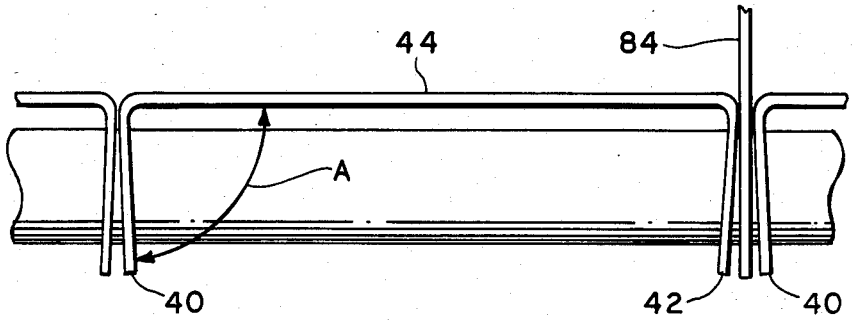

PAPER FEEDER

BACKGROUND OF THE INVENTION

Typewriters and printers typically include a long cylindrical platen and several pairs of pressure rollers that press paper against the platen. The pressure rollers must be biased up against the platen while being free to adjust their positions to fully engage the platen, and must be occasionally movable away from the platen in case it is desired to move paper without turning the platen. All of these functions typically result in the requirement for large numbers of small parts, many of them requiring custom machining or casting. The cost of the machine is increased by the large numbers of small parts that must be manufactured and assembled. U.S. Pat. No. 4,179,224 is a relatively recent example of such mechanisms. A pressure roller arrangement which minimized the number of parts required and reduced the costs for manufacturing many of the parts, would enable typewriters and printers to be constructed at lower cost.

SUMMARY OF THE INVENTION

In accordance with one embodiment of the present invention, a paper feeder is provided which can be constructed of a minimum of parts and with the parts manufacturable at low cost. The paper feeder includes a shaft of noncircular cross-section mounted on the frame of the machine rearward of the platen, a group of leaf springs having inner ends mounted on the shaft and outer ends lying under the platen, and a group of roller assemblies mounted on the outer ends of the leaf springs. Each leaf spring has tabs at opposite sides of its inner end, the tabs being bent at substantially right angles to the rest of the leaf spring, and each tab having a hole which closely receives the shaft. The leaf springs can be mounted on the shaft by merely slipping their tabs onto the shaft and using means such as pressure rings at opposite ends of the shaft to hold the springs in position with their bent-down tabs substantially abutting one another.

Each roller assembly can include a mount having upstanding arms that support a pair of pressure rollers, and a pair of depending legs that are received in a slot formed in the outer end of a leaf spring. The mount has a bottom surface which is convex to enable the mount to roll about an axis parallel to the axis of the platen, to enable the pressure rollers to move so that they both press against the platen.

The novel features of the invention are set forth with particularity in the appended claims. The invention will be best understood from the following description when read in conjunction with the accompanying drawings.

BRIEF DESCRIPTION OF THE DRAWINGS

FIG. 3 is a view taken on the line 3—3 of FIG. 2.

FIG. 4 is a view taken on the line 4—4 of FIG. 3.

FIG. 5 is a view taken on the line 5—5 of FIG. 3.

DESCRIPTION OF THE PREFERRED EMBODIMENT

Figure 1:
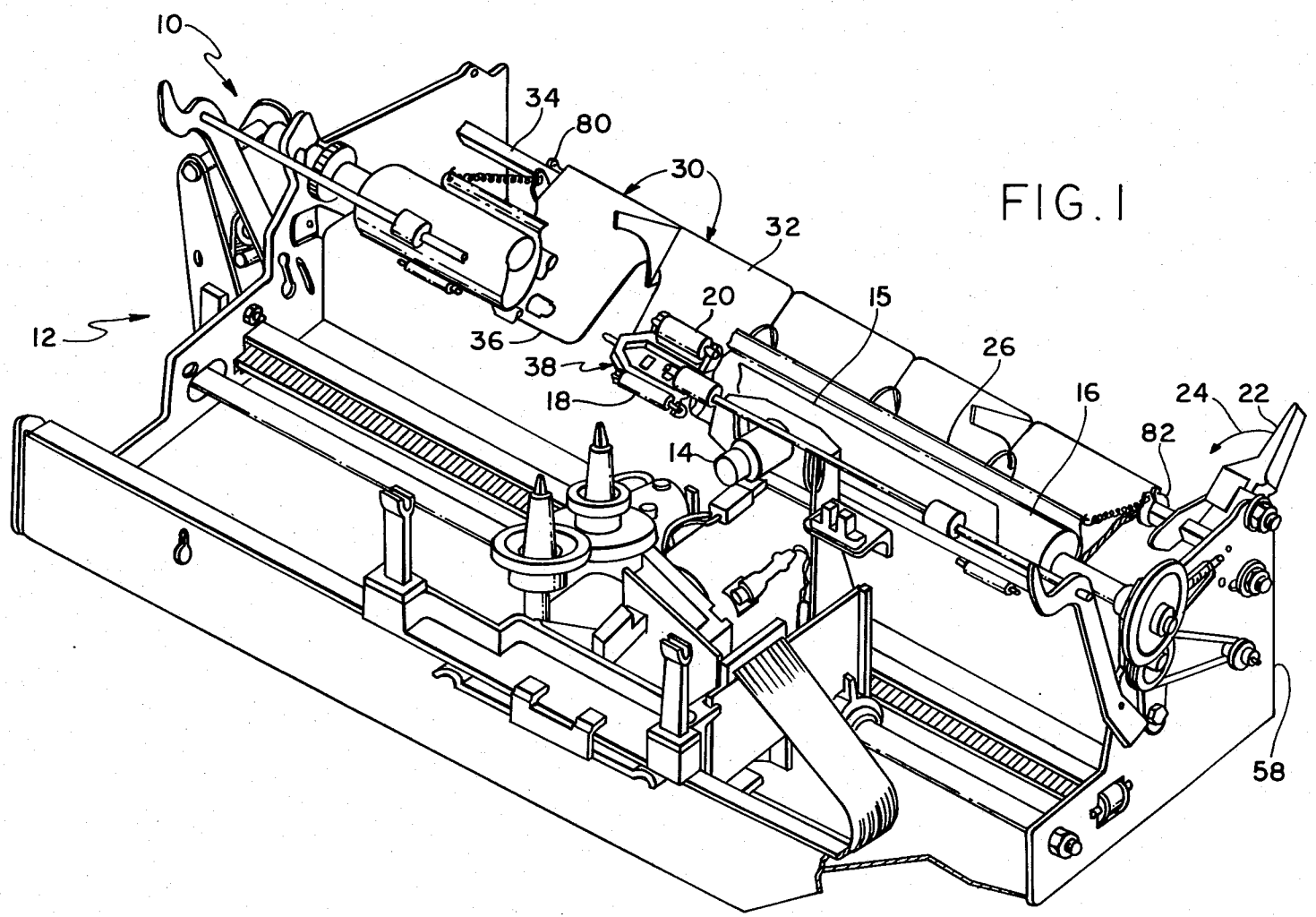
FIG. 1 is a partial front perspective view of a paper feeder constructed in accordance with the present invention, shown as part of a printer.

FIG. 1 illustrates a paper feeder 10 which is part of a printer 12 that includes a print head 14 that is driven from side to side to print on a sheet of paper 15. The paper feeder 10 feeds the paper by the use of pressure rollers 18, 20 that press the paper against the platen 16 so the paper moves as the platen turns. In order to uniformly feed both opposite sides of the paper as well as its middle portion, the paper feeder uses several pairs of the rollers such as five of them.

During normal feeding of paper, the rollers are resiliently biased upwardly and allowed to adjust their orientation slightly, so each presses firmly towards or against the platen 16 (of course, the rollers can press directly against the platen only when paper is not present). All of the pressure rollers 18, 20 also must be downwardly moveable together, when a release lever 22 is moved in the direction of arrow 24, to permit insertion or removal of paper without turning the platen. Return of the lever 22 to its original position must result in lifting of the pressure rollers to again resiliently press them against the platen. It may be noted that the rollers 18, 20 pass through holes in a paper carriage 26 in moving up and down. The large number of rollers, such as ten of them, combined with the need to normally bias each roller upward against the platen while permitting slight adjustment of roller position, and also combined with the need to enable simultaneous dropping and lifting up of all rollers, has heretofore resulted in the need for large numbers of small parts, with many of them custom machined or cast and with the need for assemblying all of the numberous parts to construct the paper feeder.

Figure 2:
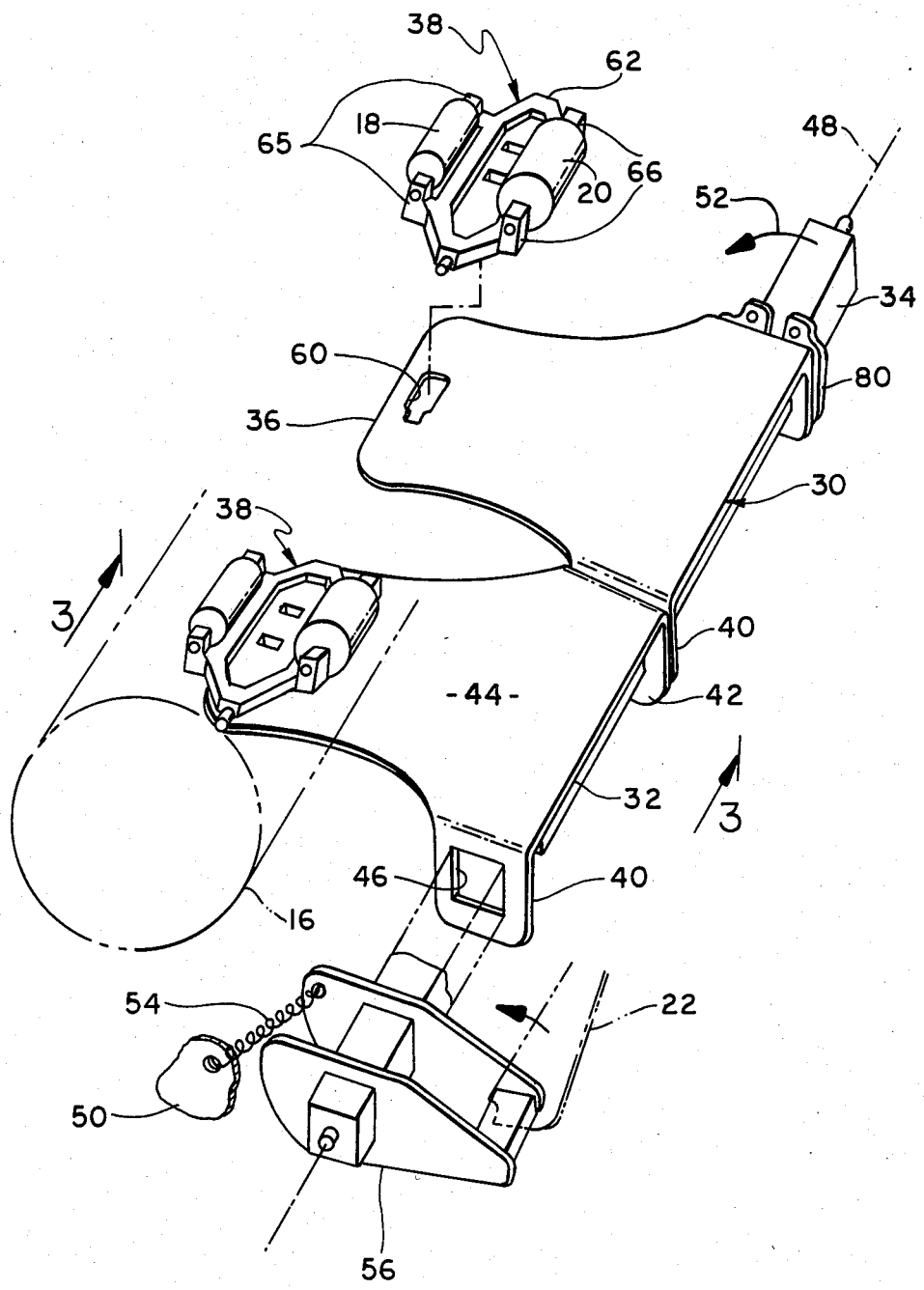
FIG. 2 is a partial rear perspective view of a portion of the paper feeder of FIG. 1.

In accordance with the present invention, the mounting of the multiple pressure rollers 18, 20 is simplified by the use of leaf springs 30. Each leaf spring has an inner end 32 that is mounted on a shaft 34 of noncircular cross-section, and an outer end 36 that supports a roller assembly 38 that includes the pressure rollers 18, 20. As shown in FIG. 2, each leaf spring 30 has a pair of tabs 40, 42 at the opposite sides of its inner end 32, which are wider than the pressure rollers. The tabs are bent down to extend by about a right angle from the major or planar leaf portion 44 of the leaf spring which lies largely in a plane. Each tab has a hole 46 which closely receives the shaft 34, to prevent the leaf spring from pivoting about the length or axis 48 of the shaft.

The shaft is pivotally mounted about its axis 48 on the frame 50 of the paper feeder machine. This permits the shaft, which is usually in a holding position wherein the rollers press against the platen, and the leaf spring is bent (as shown in FIG. 3 where the leaf is bent from its plane 51), to be pivoted in the direction of arrow 52 (FIG. 2) to a release position. In the release position of the shaft, the leaf springs are bent by less or are substantially flat, and the pressure rollers are lowered to release the paper. A spring 54 extending between the frame and a cam follower 56, urges the shaft to pivot when the release lever 22 is moved to the release position.

The outer end 36 of each leaf spring includes a slot 60 which can receive downwardly-extending legs on the roller assembly 38. The roller assembly 38 includes a mount 62 which mounts on the leaf spring, and which has two pairs of upstanding arms 65, 66 which rotatably support the pressure rollers 18, 20 about axes parallel to the length of the platen. As shown in FIGS. 3 and 4, the mount 62 has a bottom surface 64 which rests against the upper surface 30*u* of the leaf spring. The mount has a pair of legs 66, 68 which extend downwardly from the level of the bottom surface 64 of the mount 62, and which are received in the slot 60 of the leaf spring. The bottom of each leg forms an enlargement or abuttment 70, at least in a direction opposite to the other leg, to form a ledge 72 that can engage the lower surface 30*b* of the leaf spring. This prevents removal of the pressure roller mount after it has been inserted. The legs 66, 68 can deflect resiliently to permit insertion and resist removal.

The bottom surface 64 of the mount which rests on the leaf spring, is convex, as seen in a cross-sectional view of the platen 16, so that the mount can rock in the direction of arrows 74 about axes parallel to the axes of the roller 18, 20. This permits the mount to adjust position so that both of the pressure rollers 18, 20 can make line contact with the cylindrical surface of the platen 16. The distance D between the bottom surface 64 of the mount and the ledge 72 is more than 0.5 milimeter greater than the leaf spring thickness T to accomodate such rocking; a distance D of more than 0.2 millimeter greater than the thickness T of the leaf spring, would not normally be permitted where a good tight fit is desired. Also, the leaf spring slot is of sufficiently greater width than the legs 66, 68 as seen in FIG. 3, to permit such rocking. Thus, the provision of a convex bottom surface 64 on the mount plus the use of legs 66, 68 that loosely grip the leaf spring, permits adjustment of the pressure roller positions.

The leaf springs 30 can be constructed at low cost, from strips of spring steel. It is only necessary to punch out the leaf springs, with the slot 60 also being punched out, and to bend over the tabs 40, 42 at either side of the leaf spring. The group of leaf springs can be mounted on the shaft by merely sliding them onto the shaft, and using a pair of pressure rings 80, 82 (FIG. 1) at opposite ends of the shaft to fix the positions of the leaf springs along the shaft. As shown in FIG. 5, the angle A between the major portion 44 of each leaf spring and the bottom of its tabs, is less than 90°, so that the tabs abut one another near their upper or main portions 44 where there is little springiness. This avoids having the tabs abut one another at their bottoms where they would spring together and apart and permit some looseness in the assembly. The assembly uses a minimum number of relatively simple parts, with only the mount 62 being a relatively complex injection molded part. It may be noted that not all tabs of the leaf springs may abut one another, in that a thin part 84 is used by applicant which is mounted on the shaft between a pair of leaf springs to limit rearward movement of the paper cradle 26 which has holes through which the pressure rollers extend, but in any case the tabs 40, 42 substantially abut one another.

Thus, the invention provides a paper feeder which is of a simplified construction that utilizes a minimum of total parts and a minimum of special parts that must be molded or machined. This can be accomplished by the use of leaf springs having inner ends with tags at opposite sides that have holes which receive a noncircular shaft to provide simple mounting on the shaft while also providing a spring that urges a roller assembly at the outer end of the leaf spring up against the platen. The outer end of the leaf spring can include a simple slot, while the roller assembly can include a mount with a pair of legs that are loosely received in the slot and with the mount having a convex bottom surface which rests against the leaf spring but which can rock thereon.

Although particular embodiments of the invention have been described and illustrated herein, it is recognized that modifications and variations may readily occur to those skilled in the art and consequently, it is intended that the claims be interpreted to cover such modifications and equivalents.

What is claimed is:

1. In a paper feeder which includes an elongated cylindrical platen rotatable with respect to the frame of the paper feeder, the improvement of a pressure roller assembly for pressing paper against the platen comprising:

a shaft of noncircular cross-section mounted on said frame;

a plurality of leaf springs, each having a largely planar leaf portion, each leaf spring having an inner end mounted on said shaft, an outer end, and opposite sides; and a plurality of roller assemblies, each including a mount and a pair of pressure rollers parallel to the axis of said platen, said mount being curved to permit rocking on an axis parallel to and midway between the axes of said rollers, each roller assembly mounted on the outer end of one of said leaf springs and with the leaf spring resiliently bent to press the rollers toward the platen;

each leaf spring having tabs at the opposite sides of its inner end which are bent at substantially right angles to said largely planar portion, each tab having a hole which receives said shaft closely enough to prevent rotation of the leaf spring on the shaft, and the tabs of adjacent leaf springs substantially abutting each other to fix the spacing of the rollers along the length of the platen wherein:

the outer end of each leaf spring has a slot;

the mount of each roller assembly has a lower surface that rests on a leaf spring, two pairs of upstanding arms each rotatably supporting a roller in rotation about an axis extending parallel to the length of the platen, and a pair of legs extending downwardly from its lower end and received in the slot of a leaf spring;

each leg has an enlarged lower end for engaging the leaf spring to resist removal of the legs;

the enlargement on each leg is spaced from the lower surface of the mount by more than the thickness of the leaf spring; and the lower surface of the mount is convex to permit rocking of the mount on the leaf spring about an axis parallel to the axes of the rollers, whereby to permit one roller to move up and the other down so they both press paper firmly against the cylindrical platen.

* * * * *